United States Patent [19]

White et al.

[11] Patent Number: 4,722,850

[45] Date of Patent: Feb. 2, 1988

[54] DISPOSABLE CONTAINERS HAVING COLLAPSIBLE PANEL

[75] Inventors: Leonard A. White, Gurnee; James L. Cabernoch, Cary, both of Ill.

[73] Assignee: Baxter Travenol Laboratories, Inc., Deerfield, Ill.

[21] Appl. No.: 858,566

[22] Filed: Apr. 24, 1986

Related U.S. Application Data

[63] Continuation of Ser. No. 599,417, Apr. 12, 1984, abandoned.

[51] Int. Cl.[4] ..... A61J 9/00; A61J 9/08

[52] U.S. Cl. ..... 426/111; 426/115; 426/117; 426/110; 206/499; 215/11.1; 215/11.3; 215/11.6

[58] Field of Search ..... 215/11 R, 11 C, 11 E, 215/1 R; 383/80, 104, 119; 426/115, 117, 110, 111; 222/83, 89, 95, 107; 206/603, 217, 499; 229/75, 113, 111; 220/462, 23.6, 70, 69; D24/47

[56] References Cited

U.S. PATENT DOCUMENTS

| | | | |
|---|---|---|---|
| 243,547 | 6/1881 | Goldsmith | 215/1 R |
| 1,659,383 | 2/1928 | Thiene et al. | 215/1 R |
| 1,811,074 | 6/1931 | Butler | 229/113 |
| 1,851,073 | 3/1932 | Wachsman | 215/1 R |
| 2,524,021 | 9/1950 | Rigby et al. | 215/11 |
| 2,541,934 | 2/1951 | Piazze | 215/11 |
| 2,604,222 | 7/1952 | Teague et al. | 215/11 |
| 2,919,800 | 1/1960 | Jarund | 206/499 |
| 3,075,666 | 1/1963 | Hoffstein | 215/11 |
| 3,097,757 | 7/1963 | Searer | 215/11 |
| 3,204,855 | 9/1965 | Boynton et al. | 229/53 |
| 3,386,604 | 6/1968 | Fields | 215/11 |
| 3,420,366 | 1/1969 | Doyle | 206/499 |
| 3,537,225 | 11/1970 | Fields | 53/14 |
| 3,651,973 | 3/1972 | Yamauchi | 215/11 |
| 3,790,017 | 2/1974 | Fitzpatrick et al. | 215/11 |
| 3,804,952 | 4/1974 | MacDonald | 426/117 |
| 3,822,806 | 7/1974 | Grimes | 215/11 |
| 3,871,542 | 3/1975 | Hammer | 215/11 |
| 3,930,286 | 1/1976 | McGowen | 222/522 |
| 4,427,705 | 1/1984 | Wyslotsky et al. | 220/70 |
| 4,440,316 | 4/1984 | Christine | 222/83.5 |
| 4,469,249 | 9/1984 | Malpas et al. | 222/83 |

FOREIGN PATENT DOCUMENTS

| | | |
|---|---|---|
| 678539 | 1/1964 | Canada . |
| 1347668 | 2/1974 | United Kingdom . |

*Primary Examiner*—Steven Weinstein

*Attorney, Agent, or Firm*—Robert M. Barrett; Paul Flattery; Kay Pierce

[57] ABSTRACT

A disposable container is provided that has a semi-rigid generally concave body and a collapsible panel sealing an open mouth of the semi-rigid body. An access assembly is mounted to the outside surface of the semi-rigid body. Liquid sealed within the semi-rigid body by the collapsible panel is removed through the access assembly, during which removal the collapsible panel collapses to generally conform to the generally concaved shape of the body. Space efficient assemblies of these disposable containers are also provided.

13 Claims, 13 Drawing Figures

FIG. 5
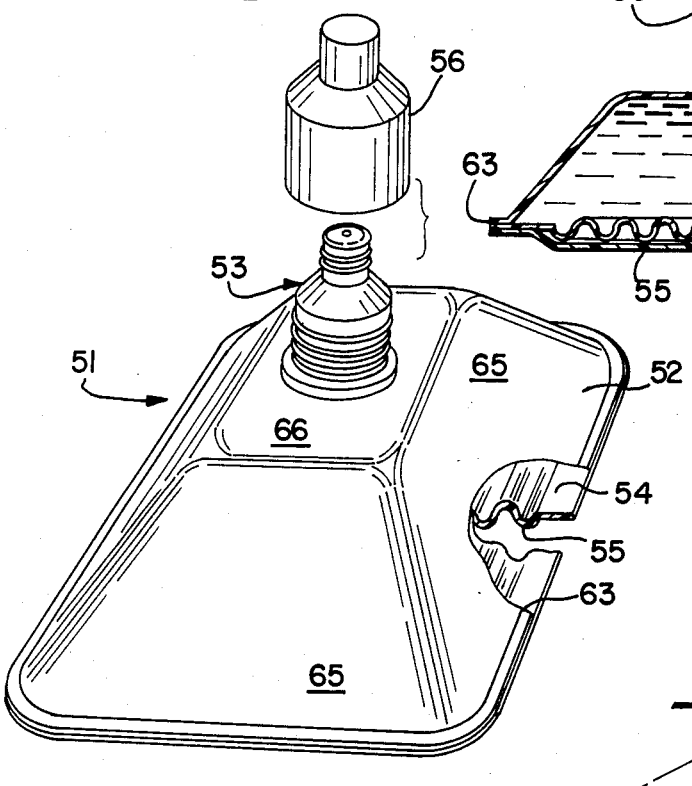
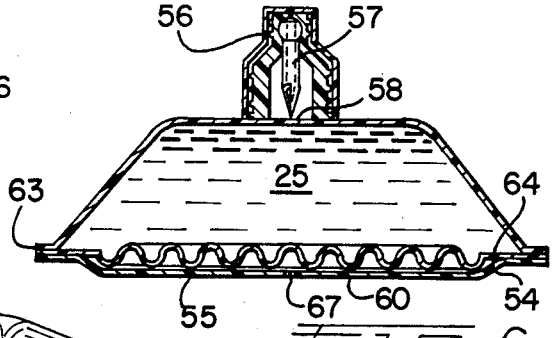
FIG. 6
FIG. 7
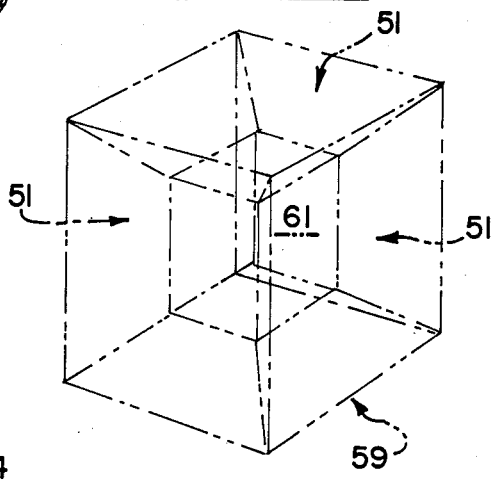
FIG. 8
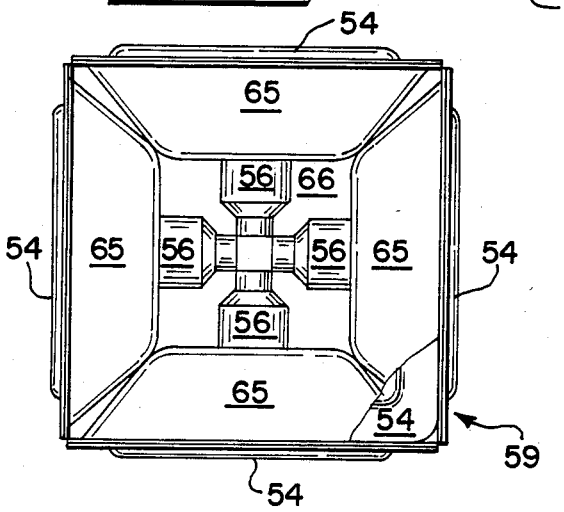

DISPOSABLE CONTAINERS HAVING COLLAPSIBLE PANEL

This application is a continuation of application Ser. No. 599,417, filed Apr. 12, 1984, now abandoned.

This invention generally relates to improved disposable containers such as nursers for feeding food formula to infants or the like. More particularly, this invention relates to disposable containers that also function as the distribution packages for a liquid sealed therewithin such as an infant food formula, the containers having a semi-rigid, shaped body member within which food formula or the like is sealed by a flexible and collapsible panel. An access assembly such as a nurser nipple assembly is secured onto the outside surface of the semi-rigid shaped body member. The disposable container is a shelf-stable, aseptic or sterile package for a feeding unit of formula or the like that is autoclaved if desired and which can be safely stored under room temperature conditions. The access assembly is structured in order to readily gain fluid-passing access to the liquid within the container when it is desired to dispense the liquid unit. Preferred embodiments are advantageously sized and shaped in order to enhance the efficiency with which the product is packaged, transported and stored.

Numerous and various nursers have long been in widespread use for the purpose of feeding food formulas, typically having a substantially liquid consistency, to infants and the like, wherein the food formula is removed from the body of these devices through a nipple having an orifice through the tip portion thereof. Prior attempts have been made to provide a body and nipple assembly that is inexpensive and that can be readily manufactured on a mass scale. Other important considerations include having a body and nipple assembly that is readily sterilizable, such as by autoclave procedures, prior to and during filling of the body portion with formula, while also being able to withstand heating procedures that are customarily practiced prior to feeding of the formula to the infant, for example heating the container with a pan of boiling water.

When it is desired to provide a dispenser such as a nurser that also functions as a liquid storage container, further difficulties are encountered in connection with how to safely package the containers in multiple quantities in a manner such that the liquid remains securely and hermetically sealed within the body portion during sterilization or aseptic treatment, packaging, storage, heating and handling, while still providing easy access to the liquid when it is desired to dispense same such as when feeding formula to an infant or the like. It is especially important that these structures resist unintentional access to the liquid which would lead to leakage or to possible spoilage or contamination.

Additionally, many proposed structures contemplate utilizing a generally semi-rigid holder or shell in order to provide support for a flexible container having liquids sealed therewithin. While these flexible containers are themselves advantageous because of their simplicity and exceptionally low cost, their support by the holder or shell does require the handling and assembly of two separate components.

In accordance with the present invention, a container is provided that has a collapsible panel which reduces the internal sealed volume of the container as liquid is withdrawn therefrom through an access assembly, while generally maintaining its structure as a supported, shaped container for storing, transporting and dispensing the liquid, and also while preventing the entry of air into the container. The container includes a semi-rigid shaped body member having a liquid such as an infant food formula, which may include milk, milk-like products, fortified liquid foods, juices, water, or the like, sealed therewithin by a flexible and collapsible panel that is sealed to the peripheral edge of the mouth of the shaped body member. The access assembly, typically a nurser nipple assembly, is affixed to an outside surface of the semi-rigid shaped body member, and the access assembly is structured such that, prior to dispensing use thereof, there is no open access passageway between the access assembly and the inside of the container. Instead, the area of the semi-rigid, shaped body portion that is defined by the access assembly functions as a barrier that withstands both handling and treatments such as heating and/or autoclaving, while still permitting access therethrough when desired for dispensing such as feeding.

It is accordingly a general object of this invention to provide an improved disposable container.

Another object of the present invention is to provide an improved disposable nurser that is especially suitable for sterile or aseptic filling and/or packaging operations and that can provide feeding unit packaging and storage thereof for extended periods of time without substantial risk of contamination or leakage.

Another object of this invention is to provide an improved container that includes a semi-rigid shaped body within which liquid is sealed by a flexible panel that progressively substantially conforms to the inside, generally concave surface of the semi-rigid, shaped body.

Another object of this invention is to provide a disposable nurser which prevents the entry of air thereinto and thereby reduce the likelihood that an infant will ingest air while nursing therefrom.

Another object of the present invention is to provide a unit package for nursing food formula, which package is generally self-supporting during storage and use.

Another object of this invention is to provide an improved liquid package/dispenser that is especially compact for storage purposes.

Another object of the present invention is to provide an improved assembly of unit packages for liquids, which assembly is generally cubic and wherein the packages contact one another along respective semi-rigid walls thereof.

BRIEF DESCRIPTION OF THE DRAWINGS

These and other objects of the present invention will be apparent from the following detailed description, including the drawings, wherein:

FIG. 5 is a perspective view, partially broken away, illustrating a further embodiment of a container according to this invention;

FIG. 6 is a cross-sectional view of the container illustrated in FIG. 5, and having an access assembly that includes a nipple;

FIG. 7 is a schematic illustration of a packaging assembly including six of the containers of FIG. 5 packaged into a generally cubic grouping;

FIG. 8 is an elevation view of the assembly schematically illustrated in FIG. 7, the front-side container being substantially completely broken away;

Figure 1:
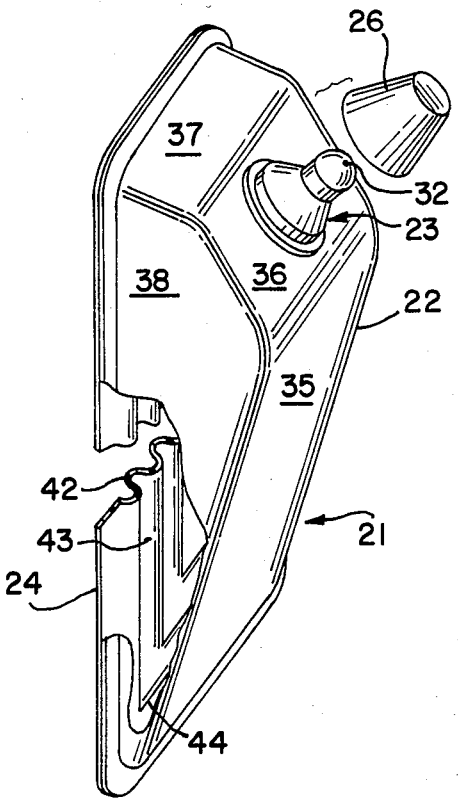
FIG. 1 is a perspective view, partially broken away, of an embodiment of the container according to this invention, useful as a packaging container/nurser for infant food formula.
Figure 2:
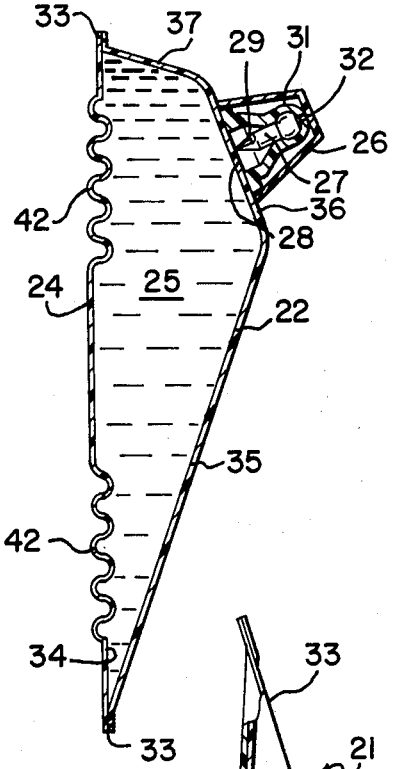
FIG. 2 is a longitudinal sectional view of the container illustrated in FIG. 1.

The disposable container illustrated in FIGS. 1 through 4, generally designated as 21, includes a semi-rigid shaped body member 22, an assembly 23 that is sealed thereonto, and a flexible and collapsible panel 24, which seals a liquid 25 such as nursing formula within the semi-rigid shaped body member 22. A protective overcap 26 may be included, particularly when the access assembly 23 is a nurser nipple assembly.

Access assembly 23 is of the piercing type and includes a spike 27 that is generally longitudinally movable within the access assembly 23. By manipulation of the spike 27 or associated portions of the access assembly 23, the spike 27 moves downwardly until it punctures an access area 28 defined on the semi-rigid shaped body member 22 by the access assembly 23. At the time that the spike 27 punctures the access area 28, the liquid 25 is free to enter a bore 29 within the spike 27, into a protruding portion 31 of the access assembly 23 and out of the access assembly 23 through an orifice 32. Until the spike 27 is thus manipulated, the liquid 25 is hermetically and at least aseptically sealed within the semi-rigid shaped body member 22. Further details regarding the access assembly 23 and associated spikes 27 that are suitable for use in the combination of this invention, when such take the form of a nurser nipple assembly, are found in copending U.S. patent application Ser. No. 840,523, now U.S. Pat. No. 4,640,424, filed on the same date as this application, in the name of Leonard A. White, entitled "Self-Opening Nipple Construction and Nursing Container", owned by the assignee of the present application. The disclosure of this copending application is hereby incorporated by reference hereinto.

With reference to the semi-rigid shaped body member 22, such has a generally shallow, concave configuration and includes a peripheral sealing edge 33, defining a wide mouth 34. An elongated panel 35 extends from one end of the peripheral sealing edge 33 to a truncating panel 36, which preferably includes the access area 28. A short side panel 38 extends between an opposite edge of the peripheral sealing edge 33 to an opposite side of the truncating panel 36. Side panels 38, 39 extend between longitudinal sides of the peripheral sealing edge 33 and respective edges of the elongated panel 35, the truncating panel 36 and the short side panel 37, whereby the side panels 38, 39 are defined to have a truncated triangular configuration.

Figure 3:
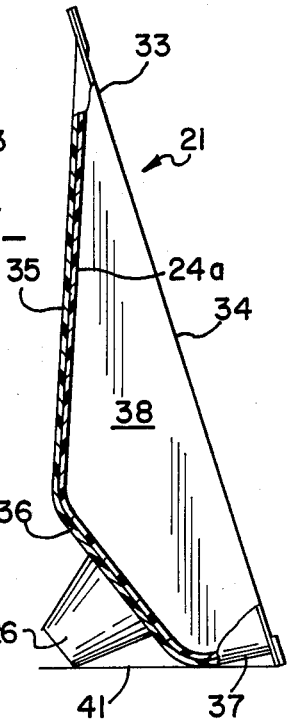
FIGS. 3 and 4 are side elevational views, FIG. 3 being substantially broken away, illustrating different orientations of the container shaped according to FIG. 1, when resting on different ones of its sides.
Figure 4:
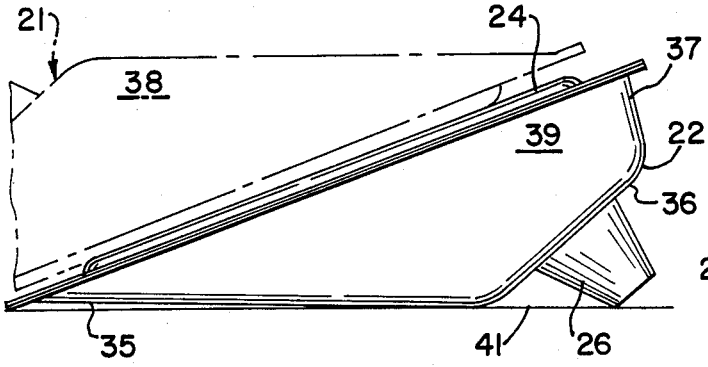

By virtue of this generally truncated triangular configuration of the side panels 38, 39, the disposable container 21 has the ability to assume a stable standing position onto a flat surface 41 that is either generally vertical, as illustrated in FIG. 3, or that is generally horizontal, as illustrated in FIG. 4. Additionally, this configuration permits the disposable containers 21 to be stacked in generally abutting relationship with each other, which relationship is also protective of the flexible and collapsible panel 24. The preferred abutting relationship in this regard is one in which respective peripheral sealing edges 33 of two different disposable containers 21 abut each other when the containers 21 are oriented generally opposite of each other as illustrated in phantom in FIG. 4.

Regarding the flexible and collapsible panel 24, such is a bellows-like structure which lies generally flat when liquid 25 completely fills the total volume of the semi-rigid shaped body member 22 and which collapses into the semi-rigid shaped body member 22 as the liquid 25 is withdrawn from the shaped body member 22 through the access assembly 23. In longitudinal cross-section, the total linear length of the flexible and collapsible panel 24 is approximately the same as the corresponding longitudinal cross-sectional inside length of the combined elongated panel 35, truncating panel 36 and short side panel 37 of the body member 22. The total linear length of a transverse cross-section through the collapsible panel 24 is approximately the same as a corresponding internal transverse cross-section of the shaped body member 22. With such a structure, the collapsible panel 24 will substantially overlie and conform to the general shape and size of the inside surface of the body member 22 when substantially all of the liquid 25 has been removed from the container 21.

Figure 13:
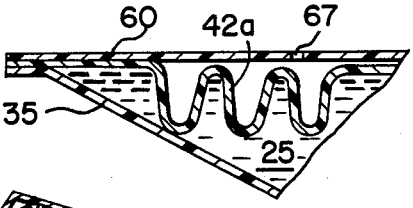
FIG. 13 is a cut-away sectional view illustrating a container with a collapsible panel having unilaterally symmetrical convolutions.

The preferred structure of the flexible and collapsible panel 24 includes bilaterally symmetrical convolutions 42 within the flexible and collapsible panel 24. Such convolutions 42 include a generally longitudinal component 43 and a generally transverse component 44. Unilaterally symmetrical convolutions 42*a* may be provided, as illustrated in FIG. 13. In either case, upon total collapse of the flexible and collapsible panel 24, same assumes a generally extended and collapsed configuration 24*a* as illustrated in FIG. 3.

Generally speaking, the semi-rigid shaped body member 22 is made of a synthetic material that is suitable for forming into the desired shape. Other molding techniques could be utilized if desired, such as impact forming, injection molding or the like. The protective overcap 26 will typically be molded from inexpensive polymeric materials. It is particularly desirable that the collapsible panel 24 be thin and that its gauge be controlled within close tolerances. Such thin parts are not suited to injection molding. They may be thermoformed from sheet within close tolerances. Fusion molding is an especially suitable procedure for making the flexible and collapsible panel 24. Fusion molding is a generally known technique that includes coating a male mold, fusing the coating into a thin film having a configuration of the flexible and collapsible panel 24, cooling the collapsible panel 24, and releasing it from the mold. The resulting collapsible panels 24 consistently fall within close tolerances of thinness and sizing.

With reference to the embodiment illustrated in FIGS. 5 through 8, the disposable container 51 thereof includes a semi-rigid shaped body member 52, a semi-rigid support member 60, an access assembly 53 that may be a nurser nipple assembly, a flexible and collapsible panel 54, liquid 25 such as nursing formula sealed therewithin, and an optional protective overcap 56. Preferably, the access assembly 53 includes a spike 57 for piercing access area 58 of the semi-rigid, shaped body member 52.

The semi-rigid shaped body member 52 includes a peripheral sealing edge 63 defining a wide mouth 64 of the semi-rigid shaped body member 52. The general configuration of the body member 52 is that of a truncated pyramid having four substantially identical generally trapezoidal side panels 65 that extend from the peripheral sealing flange 63 to a truncating panel 66. Flexible and collapsible panel 54 includes a plurality of convolutions 55 that impart the collapsibility needed such that the collapsible panel 54 collapses generally into the semi-rigid shaped body member 52 when the liquid 25 is withdrawn therefrom through the access assembly 53.

Regarding the semi-rigid support assembly 60, such may be provided, if desired, for any embodiment by being sealed or otherwise attached to overlie and support the collapsible panel 54 to prevent outward distortion of the collapsible panel 54 when the disposable container 51 is in use. The semi-rigid support 60 includes at least one aperture 67 to permit entry of air between the support 60 and the collapsible panel 54. Support 60 may, for example, be generally grid-shaped (not shown) and include numerous apertures.

As can be seen from FIGS. 7 and 8, the truncated pyramidal shape of each disposable container 51 permits same to form a cubic assembly, generally designated as 59, including six containers 51 as illustrated. Cubic assembly 59 is exceptionally compact and efficient of volumetric space, whereby the volume occupied by the cubic assembly 59 is only somewhat greater than the volume of liquid within the six containers 51, the difference in volume being generally equal to the central cube 61 needed to accommodate the six access assemblies 53 and, when provided, protective overcaps 56.

Figure 9:
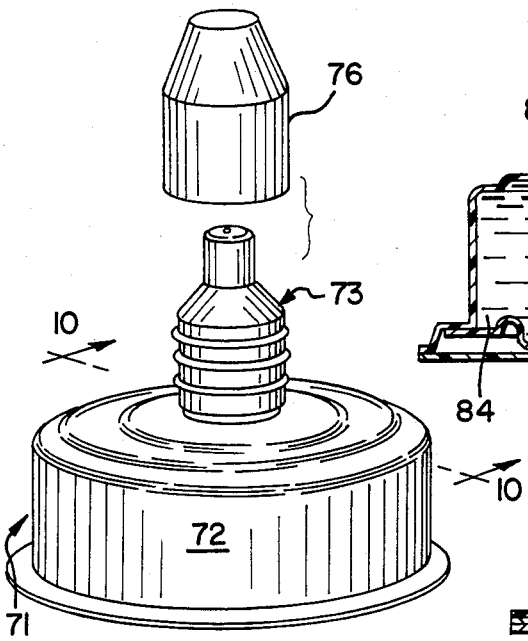
FIG. 9 is a perspective view of a further embodiment according to this invention.
Figure 10:
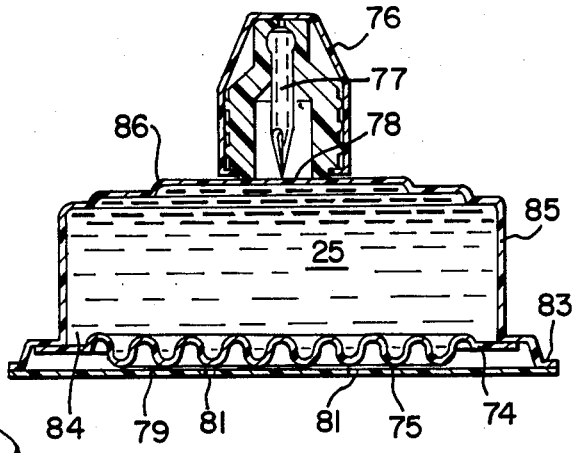
FIG. 10 is a sectional view along the line 10—10 of FIG. 9 and upon which the overcap is assembled thereonto.

FIGS. 9 and 10 illustrate an embodiment of a disposable container 71 that includes a semi-rigid shaped body member 72 having an access assembly 73 sealed thereto, a flexible and collapsible panel 74 for sealing liquid 25 within the body member 72, and an optional protective overcap 76. Preferably, the access assembly 73 includes a spike 77, poised for piercing an access area 78 of the semi-rigid shaped body member 72. An optional semi-rigid support 79 having apertures 81 may overlie the collapsible panel 74.

Semi-rigid shaped body member 72 is generally right cylindrical in configuration, having a peripheral sealing edge 83 and a mouth 84, which is an open end of a cylindrical side panel 85, at the other end of which is a generally circular end panel 86. The flexible and collapsible panel 74 includes generally concentric convolutions 75 in order to impart the desired collapsibility thereto.

Figure 12:
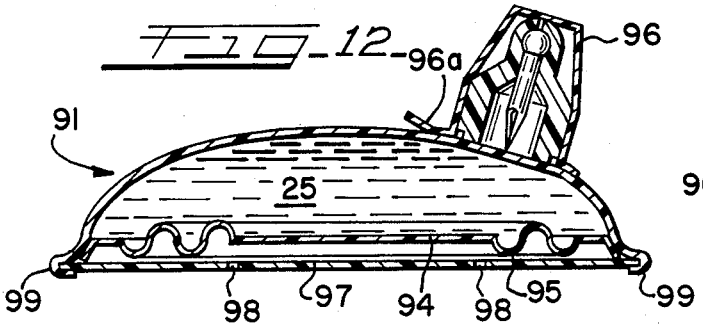
FIG. 12 is a sectional view along the line 12—12 of FIG. 11.
Figure 12:
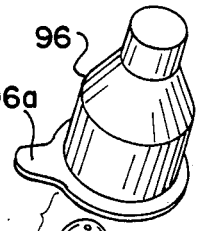
Figure 11:
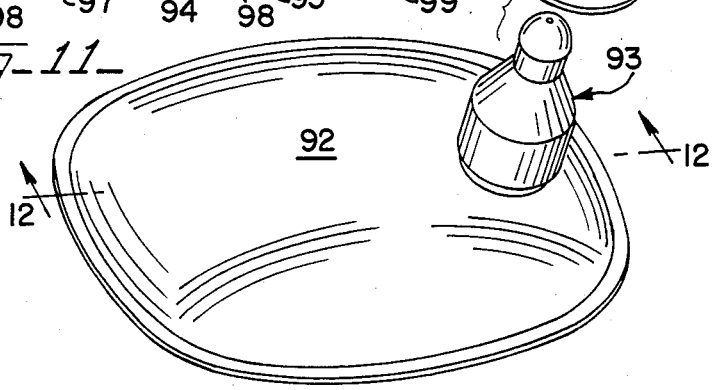
FIG. 11 is a perspective view of a further embodiment of the container according to this invention.

The disposable container 91 illustrated in FIGS. 11 and 12 includes a semi-rigid shaped body member 92 that has a generally arcuate longitudinal cross-section, to which body member 92 is securely affixed an access assembly 93 and a flexible and collapsible panel 94, liquid 25 being sealed within the semi-rigid shaped body member 92. An optional protective overcap 96 may be provided, such including a pull tab **96*a* for ready removal thereof. Generally rectangular convolutions 95 are included within the flexible and collapsible panel 94 in order to impart the needed collapsibility thereto. If desired, a semi-rigid support 97 having apertures 98 may be provided. A rolled edge 99** may also be included in order to minimize sharp edges.

While various particular embodiments of the invention have been described herein, it will be apparent to those skilled in the art that various modifications thereof may be made without departing from the true spirit and scope of the invention. Accordingly, it is intended by the appended claims to cover all such modifications and equivalents which embody inventive features as defined in the claims.

We claim:

1. A disposable container for a liquid, comprising:

a semi-rigid shaped body member having a wide mouth, a peripheral edge along said wide mouth and two generally opposing side panels having a generally truncated triangular configuration, no two sides of which are parallel, a truncating panel joining said upstanding side panels, an elongated panel joining said upstanding side panels and one end of the truncating panel and a short side panel joining said upstanding side panels and an opposing end of the truncating panel;

a flexible and collapsible panel having a peripheral edge, said peripheral edge of the flexible and collapsible panel being sealed to said peripheral edge of the semi-rigid shaped body member to define a substantially maximum volume of the container;

an access assembly affixed onto the outside surface of said truncating panel of said semi-rigid shaped body member;

liquid sealed by said flexible and collapsible panel within said semi-rigid shaped body member, said liquid having a volume substantially the same as said substantially maximum volume;

said panel and access assembly oriented relative to each other such that the disposable container is capable of assuming a stable standing position on a flat surface along its longitudinal axis either vertically or horizontally;

said flexible and collapsible panel lies generally flat across said wide mouth when said liquid fills said substantially maximum volume and collapses into said semi-rigid shaped body member which reduces the volume between said semi-rigid shaped body member and said flexible and collapsible panel to less than said substantially maximum volume when the liquid is removed through said access assembly, said reduced volume being generally equal to the volume of liquid remaining between said semi-rigid shaped body member and said flexible and collapsible panel; and said flexible and collapsible panel being capable of cooperating with a flexible and collapsible panel of a second disposable container in abutting relation to allow the two containers to be positioned in a stacked relationship.

2. The disposable container of claim 1, further including convolutions within said flexible and collapsible panel.

3. The disposable container of claim 1, wherein said flexible and collapsible panel includes bilaterally symmetrical convolutions.

4. The disposable container of claim 1, wherein said flexible and collapsible panel has a convoluted surface having a total linear length that is substantially equal to a corresponding internal length of said semi-rigid shaped body member.

5. The disposable container of claim 1, wherein said flexible and collapsible panel is made by fusion molding.

6. The disposable container of claim 1, wherein said access assembly includes means for forming an opening through said semi-rigid shaped body member.

7. The disposable container of claim 1, wherein said access assembly includes a nurser nipple member, and wherein said liquid is a food formula.

8. The disposable container of claim 1, wherein said access assembly includes a spike that is movable through said semi-rigid shaped body member.

9. An assembly of disposable containers comprising:

a plurality of disposable containers each of which includes:

a semi-rigid shaped body member having a wide mouth, a peripheral edge along said wide mouth and defined by four substantially identical generally trapezoidal side panels that extend from the peripheral edge up to a generally flat truncating panel to impart a shape generally corresponding to a truncated pyramid;

a flexible and collapsible panel parallel to said truncating panel and having a peripheral edge, said peripheral edge of the flexible and collapsible panel being sealed to said peripheral edge of the semi-rigid shaped body member to define a substantially maximum volume of the container;

an access assembly affixed onto the outside surface of said truncating panel;

liquid sealed by said flexible and collapsible panel within said semi-rigid shaped body member, said liquid having a volume substantially the same as said substantially maximum volume;

said flexible and collapsible panel lies generally flat across said wide mouth when said liquid fills said substantially maximum volume and collapses into said semi-rigid shaped body member which reduces the volume between said semi-rigid shaped body member and said flexible and collapsible panel to less than said substantially maximum volume when the liquid is removed through said access assembly, said reduced volume being generally equal to the volume of liquid remaining between said semi-rigid shaped body member and said flexible and collapsible panel; and wherein each of said disposable containers is oriented such that each access assembly thereof is generally within the center of the assembly of disposable containers to form a generally cubic assembly.

10. The assembly of disposable containers according to claim 9, wherein said plurality of flexible and collapsible panels generally define the outside surface of the assembly.

11. The assembly of disposable containers according to claim 9, wherein, in each of said disposable containers, said flexible and collapsible panel reduces the volume between said semi-rigid shaped body member and said flexible and collapsible panel to less than said substantially maximum volume when the liquid is removed through said access assembly, said reduced volume being generally equal to the volume of liquid remaining between said semi-rigid shaped body member and said flexible and collapsible panel.

12. The assembly of disposable containers according to claim 9, wherein, in each said disposable container, said flexible and collapsible panel includes convolutions.

13. The assembly of disposable containers according to claim 9, wherein, in each said disposable container, said flexible and collapsible panel includes bilaterally symmetrical convolutions.

* * * * *